US006953627B2

(12) United States Patent
Junius

(10) Patent No.: US 6,953,627 B2
(45) Date of Patent: Oct. 11, 2005

(54) METHOD FOR THE PRODUCTION OF THIN-WALLED STEEL COMPONENTS AND COMPONENTS PRODUCED THEREFROM

(75) Inventor: Hans-Toni Junius, Iserlohn (DE)

(73) Assignee: C.D. Walzholz-Brockhaus GmbH, Hagen (DE)

( * ) Notice: Subject to any disclaimer, the term of this patent is extended or adjusted under 35 U.S.C. 154(b) by 73 days.

(21) Appl. No.: 10/221,534

(22) PCT Filed: Jan. 5, 2001

(86) PCT No.: PCT/EP01/00088

§ 371 (c)(1),
(2), (4) Date: Sep. 13, 2002

(87) PCT Pub. No.: WO01/68293

PCT Pub. Date: Sep. 20, 2001

(65) Prior Publication Data

US 2003/0029530 A1 Feb. 13, 2003

(30) Foreign Application Priority Data

Mar. 13, 2000 (DE) ..... 100 11 758

(51) Int. Cl.[7] ..... B32B 15/18; C21D 9/00

(52) U.S. Cl. ..... 428/682; 428/683; 428/686; 428/610; 428/612; 428/924; 428/925; 428/926; 428/940; 148/516; 148/527; 148/529; 148/534; 148/540; 148/541; 164/66.1; 164/76.1; 164/91; 164/98

(58) Field of Search ..... 428/682, 683, 428/686, 610, 612, 924, 925, 926, 940; 148/516, 527, 529, 534, 540, 541; 164/66.1, 76.1, 91, 98

(56) References Cited

U.S. PATENT DOCUMENTS

| | | | | |
|---|---|---|---|---|
| 3,457,984 A | | 7/1969 | Yoshida et al. | |
| 5,418,074 A | * | 5/1995 | Grell | 428/683 |

FOREIGN PATENT DOCUMENTS

| | | |
|---|---|---|
| DE | 33 46 391 | 7/1985 |
| DE | 41 37 118 | 5/1993 |
| DE | 196 31 999 | 2/1998 |
| DE | 198 15 007 | 7/1999 |
| DE | 198 50 213 | 7/1999 |
| EP | 0 891 826 | 1/1999 |

* cited by examiner

*Primary Examiner*—Robert R. Koehler
(74) *Attorney, Agent, or Firm*—Collard & Roe, P.C.

(57) ABSTRACT

A process for the production of thin walled parts of steel, wherein there are layers that are at least partly differently treatable relating to their strength and hardness qualities. This process can include creating a composite material from a plurality of different layers by connecting at least one core layer and at least one surface layer together. At least one layer of the core or surface layer is cast adjacent to another layer to form a composite material having an alloy gradient that is flat at each interface between any of the core layer or the surface layer. Next, the process can include deforming the composite material along a length of these layers. Finally the process can include heat treating the layers to transform the strength and hardness qualities of at least one of these layers.

30 Claims, 2 Drawing Sheets

METHOD FOR THE PRODUCTION OF THIN-WALLED STEEL COMPONENTS AND COMPONENTS PRODUCED THEREFROM

CROSS REFERENCE TO RELATED APPLICATIONS

Applicant claims priority under 35 U.S.C. 119 of German Application No. 100 11 758.9 filed Mar. 13, 2000. Applicant also claims priority under 35 U.S.C. §365 of PCT/EP01/00088 filed Jan. 5, 2001. The international application under PCT article 21(2) was not published in English.

BACKGROUND OF THE INVENTION

1. Field of the Invention

The invention relates to a procedure for the production of thin-walled parts made of steel, which show an inner core layer and outer boundary layers. These layers are, formed based on their strength and hardness qualities, and at least partly differently treatable during a process. Furthermore, the invention relates to thin-walled parts made of steel with an inner core layer and outer boundary layers.

Thin-walled parts made of steel with a wall thickness of less than 4 mm, have a particularly high stress resistance which is demanded. This type of stress is for instance in mechanical engineering and vehicle engineering, wherein these parts are first thermoformed and/or cold-coiled, machined by metal-cutting or non metal-cutting and then tempered by a thermal treatment, namely tempered martensitic or bainitic. Out of hardened steel a part arises with continuous, uniform, high hardness along the complete cross section which has a low toughness. A more favourable combination of wear resistant surfaces with high toughness in the inner zone is achieved by the use of case hardened steels. This result can occur by a carbonizing treatment in a thermochemical hardening process wherein tempered, hard surface layers are produced while furthermore the inner core keeps a high toughness. This production procedure requires great effort and contrasts with the advantageous use qualities, however. A distortion of hardening is namely unavoidable through the relatively long case-hardening time of for example 180 minutes at 850–950 degrees Celsius and the following quenching in the oil bath or in the gas current. This process causes measure and form deviations which require an effortful subsequent treatment which quite considerably increases the production effort and expense. In addition, there is a relatively rough hardness structure which has an austenitic grain size according to DIN 50601 of for example 5 or 6. There is also a tendency towards intercrystalline failures which arise from the intercrystalline grain boundaries.

2. The References

As a substitute for the case hardening, furthermore the use of roll-bonded steel is known in which two or more, different alloyed tapes or panels get rolled together preferably from cold tape. By the pressure and the temperature, the core and surface layers of different alloyed steels are connected intimately with each other at the surfaces in the roll gap. A metallic compound arises from the following anneal by diffusion events. Such a roll bonding procedure is indicated in the reference DE 41 37 118 A1, for example. An abrupt, volatile changeover arises from it, however, between the different material layers. The hardness transition between layers that are tempered and not tempered is also therefore appropriately steep so that due to the load induced tension gradients, relatively thick surface layers must be produced. Through these relative tensions, the latent danger exists at the contact surface moreover unavoidably so that the peripheries chip off during use by transgression of the apparent yielding point in the joint area. This disadvantage can, as mentioned above, merely be met by surface layers being dimensioned more thickly. This result however, in turn leads to an unwanted higher wall thickness of the parts and moreover makes the production more difficult. The reference DE 196 31 999 A1 has already been suggested certifiable for the production of composite sheet metals in a continuous casting installation by casting together core and surface layers. Through this process, a steel layer material shall be produced. The difficulties at the production of layers which are differently tempered or hardened aren't taken up, however.

A similar continuous casting procedure is mentioned in the reference DE 33 46 391 A1 at which layer sheet metals are also embedded in a melt. The difficulties in the formation of layers which are differently tempered or hardened also aren't mentioned. The aforementioned continuous casting procedures and installations are obviously moreover suitable for only the production of relatively thick blanks or sheet metals and not for the production of thin-walled parts. It similarly behaves with U.S. Pat. No. 3,457,984 for the resulting level for the technological development. This reference refers, to or covers the casting rope of a continuous casting installation with sheet metal. Procedures and thin metal straps produced accordingly to the procedures are known of the reference DE-A-195 15 007 and the reference DE-A-198-50 213, in which a core material in layers of an economical material are spilled with thin metal straps to a composite material by a casting process, in which the thin metal straps are of use for the production of corrosion resistant and/or particularly smoother outer layers. A following treatment is not mentioned with respect to the influencing of other qualities of the composite material also here.

SUMMARY OF THE INVENTION

The invention relates to an efficient procedure for the production of thin-walled parts made of steel with different strength and/or hardness qualities. Furthermore, a part with layers shall have different strength and/or qualities and can be produced particularly more economically than before and also with a reduced effort. The procedure according to the invention provides the following procedure steps:

- connecting of core and surface layers from differently treatable steel alloys in a casting procedure to a composite material with an alloy gradient going flatly at the interfacials,
- deforming the composite material on the size of the thin-walled parts,
- heat treating the parts after which the layers of the differently treatable steel alloys show different strength and/or hardness qualities.

The procedure that relates to the invention shows the advantage of combining core and surface layers with each other from steel materials with different strength and/or hardness qualities, namely particularly different martensitic hardenability qualities so that thin-walled parts which unite the respective advantages of the case hardening and the roll bonding into themselves are made available. In detail, a strength distribution is caused by the heat treatment according to invention with respect to the strength and/or hardness qualities of the composite material which is comparable with a known case-hardening process considered especially advantagous. Unlike case-hardening however, practically no delay appears during the procedure according to invention, so that there is a precise, measure and form to create an exact part that is made available without measure corrections being required. Furthermore accordingly to the invention the predefined, a flat alloy gradient at the interfacials between the layers is avoids the formation of inner material notches as they are unavoidable at the roll bonding process, as mentioned at the beginning. Due to the hardness and strength gradient optimized by this feature, no more danger exists wherein the surface layers chip off by exceeding the tensile strength in the joint area. This occurs at the interfacial surface, at a high load tension. Preferably, the individual layers of steel alloys have different martensitic hardenability qualities, i.e. different contents of carbon, chrome and manganese, in which the following influencing of the strength and/or hardness qualities is made by martensitic or bainitic heat treatments, that means a heat treatment with the following steps of heating up—quenching—and then tempering.

In particular, these layers are influenced so that their strength and/or hardness qualities consist of higher alloyed materials, that means carbon richer steel than that of the layers that are not influencable in their strength and/or hardness qualities. In this case, a carbon gradient that extends appropriately flatly is formed in the area of the alloy gradient extending flatly. This transition zone between higher carbon and lower carbon layers extends at a wall thickness of the parts of less than 4 mm at less than 20%, preferably less than 15% of the wall thickness. In any case, the area of the flat alloy or carbon gradient that is broader than 0.1 mm is around more than a range broader than 0.1 mm as at the known roll bonding procedure. Preferably the layers influencable in their strength and/or hardness qualities form the surface layers of the parts, which through this, get hardened in their surface and get a hardness course which is approximately similar to that by case hardening. The disadvantage of the case hardening, is that due to the long residence time, a relatively rough grain structure appears in the peripheries which leads to an increased micro-crack sensitivity. However, this feature is avoided by the layer order according to the invention. Through relatively short residence times, a wear resistant fine grain structure with high toughness also results namely in the surface layer in the periphery which leads to a particularly little microcrack sensitivity. Preferably, parts can be produced by a procedure according to invention with a wall thickness of less than 4 mm. These layers are influencable in their strength and/or hardness qualities, that means the martensitic hardened layers, have a crosscut part of about 10% to 50% of the wall thickness. Alternatively, the core layer of the parts can be influencable in their strength and/or hardness qualities, for example hardened, while the surface layers consists of steel alloys not influencable in their strength and/or hardness qualities or stainless steels.

The layers influencable in their strength and/or hardness qualities can be made of materials as for example C 55, C 67 or other steels of the EN, 100 Cr 6 or X 20 Cr13, X 35 CrMo 17 form preferably the boundary layers, while the core layers are made of materials not influencable in their strength and/or hardness qualities as for example DC 01 or C 10. For certain applications, these layers influencable in their strength and/or hardness qualities can also form the central layers, however, for example a spring steel core made of C 60, C 67 or C 75, while the surface layers consist of well deformable steels such as C 10 or DC 01 or also of stainless steels like X 5 CrNi 1810. The alloy gradient according to the invention between the surface and the core layers can be provided so that for the production of the composite material for the surface layers, blanks are ordered to extend parallel to each other wherein these blanks are made of hardenable martensitic steel and the core layer situated in between is spilled with fused, carbon poorer steel.

To provide the surface layers, for example cold or surface treated warm tape is used with predefined chemical analysis, particularly with a large carbon amount. The core material is spilled fusably in between this, which has a lower carbon content. Thus, there is a local on-glaze of the blanks at the material interfaces, wherein through diffusion processes a flat alloy or carbon gradient with a depth of about 0.1–0.3 mm is formed. These qualities are made possible by the connection according to invention by means of a final dimension near casting procedure.

The blanks preferably are cooled from outside by the casting wheels or the chill which is formed when casting of the fused core material. By this fact even at thin blanks, the breadth of the alloy gradient can be steered so that it is in the area of 0.1 mm and is up to 10% of the complete crosscut. It is a great advantage if the blanks are brought as steel hoops to the edge of the casting gap of a casting plant working continuously. The casting plant can alternatively be a rope casting plant with a firm open-ended mould or this casting can be equipped for the execution of a continuous process of casting and rolling with rotating rolls (casting wheels) limiting a casting gap.

According to the invention, the tape which forms the surface layers becomes introduced to the rolls or copper jaws on the edge of the glaze marsh into the casting gap lengthways on both sides. The tapes must be bright, free of cinder and oxide as well and if necessary, roughened by a corresponding surface treatment at least on its insides where the liquid core material is casted. To stop an unwanted oxidation of the wall surface by the warming at the supply end into the casting gap, it is advisable to provide steel hoops coming in or the blanks with an oxidation protecting cover. Preferably, this can be a protective gas atmosphere. Such a protective gas bell is produced by supplying of inert gas respective mixtures of inert gases. As soon as the melting of the core material comes in contact with the surface of the tape, this is heated to about 950 degrees Celsius, so that a metallic joint arises by the diffusion bonding of the melting with the surface of the tape with the flat alloy gradient according to invention.

With the tape (warm tape) forming the surface layers the warmth is further given to the copper rolls or to the wall of the chill form so that the tapes do not melt on completely what would not be desired. The result of this casting combination in the final dimension near range of the wall thickness is an increase of the casting performance since the warmth removal is made by the on-heating of the supplied surface layers. In this case, the casting gap is cooled by the supplied, cold material. A hot-rolling process preferably follows the aforementioned casting. In the case of temperatures above 950 degrees Celsius, hot rolling is guaranteed due to the high surface pressure and deformation that a complete binding of the layers is certainly achieved in the way according to the invention. In this case, the binding can occur even if the metallic joint wasn't sufficient at the contact of the melting with the tape surface. In this case, there is a flat material transition gradient between the layers, which amounts in a region of about 0.1 mm. The surface of the rolling stock gets surface of few roll marks and tinder without flame chipping or black operations.

The composite material is then rolled out by warm and/or cold rollers with an rolling ration of regularly more than 30% to a thickness of 1 to 5 mm. This process occurs preferably by following cold rolling, wherein the least forming of which coming up to requested dimensions of the wall thickness of the parts, which amounts in a region of about 4,0 mm, in which the surface shows lowest fault depths and high pore liberty, which is the prerequisite for the later use for highly stressed components, for example engine components.

If necessary, multiple cold rolling and process-anneals can be required for the definite contouring. Before the further processing by bending, pressing or something else, the composite material rolled on measure is subjected preferably to a recrystallization annealing or soft anneal at about 730 degrees Celsius. In this soft annealed state, the composite material is well suited for the cold forming, for example of engine components. Finally the composite material formed on measure is subjected for the influencing of his strength and/or hardness qualities to a heat treatment in which is carried out via a martensitic hardening of the temperable layers. The differently hardening layers, for example the surface layers, are martensitically hardened by the sequence of the procedure steps including: heating up—quenching—and tempering, while the areas less alloyed show lower hardness and furthermore keep their toughness. By means of a partial heat treatment, for example by means of laser or electron ray treatment a locally restricted influence of the strength and/or hardness qualities, this means hardening, can take be achieved. An influencing of the strength and/or hardness qualities can alternatively be carried out in the short time run procedure, prefers in a protective atmosphere furnace.

This makes possible a particularly efficient production of function optimized strip stock and components. A part which is produced according to the aforementioned procedures and thin-walled with a soft core layer and martensitic, hardened surface layer which consists of a cold formed, hardened multilayer composite material, which has carbon enriched, martensiticly hardened surface layer and relatively to this a carbon poorer core layer, in which the carbon gradient goes flatly between the layers, has particularly advantageous application possibilities. This part according to the invention stands out by the fact that it gets close to a case-hardened steel part with regard to hardness course and strength distribution. Material qualities which are not attainable with other hardness procedures can, however, be provided by the use of a multilayer composite material from different hardening destitute of martensitic layers. Due to the flat transition zone, an adjustment of the comparison tension conditions is given to the load tension curve in the crosscut. A more efficient production correspondingly arises in the context of optimized function qualities, such as a surface free of pores and decarburization without edge oxidation of the grain boundaries with an Austenit-grain size finer than 8 according to DIN 50601. Alternatively, the part can include surface layers that are not influencable in their strength and/or hardness qualities for example from stainless steel alloys, and a tempered core layer either, for example made of spring steel. The part according to the invention is preferably up to 4.0 mm. The carbon gradient in the transition zone extends in the region of about 10 to 30% of the wall thickness, therefore in any case about more than 0.1 mm. The materials for the surface and core layers are coordinated with each other preferably so that the hardness of the core layer corresponds to at least 30% to 50% of the hardness of the surface layers. The part can consist of two different materials, for example a lowly alloyed core layer and highly alloyed surface layers. The chemical composition of the surface layers also can, however, be different when required so that at least three layers are existing altogether with different material qualities. Through this can be reached a further improved function optimization of the parts like anti-corrosion protection or the possibility of fusion welding. Furthermore, with parts being produced according to the invention can these parts can be realized via asymmetrical spring ways or self adjusting spring ways or spring strengths.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
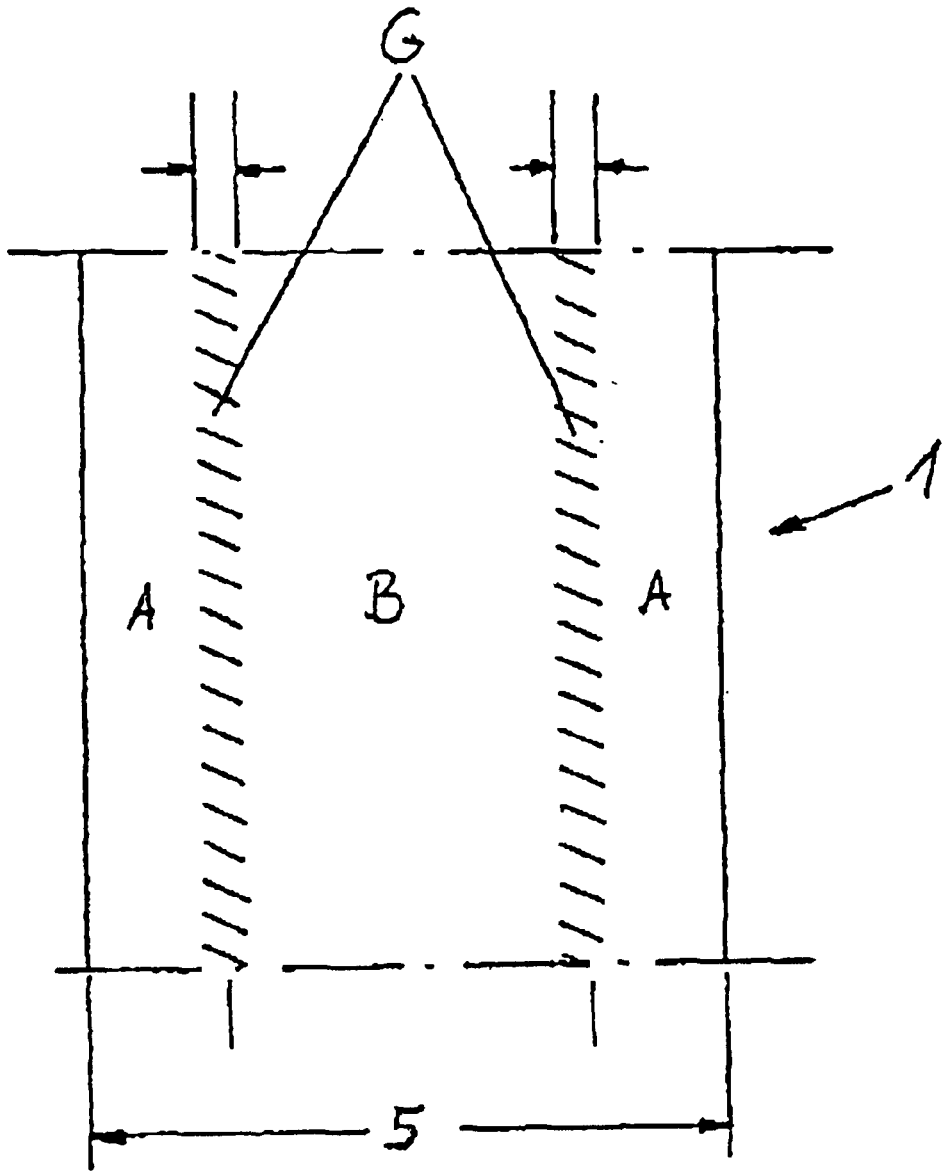
FIG. 1—shows a crosscut through a Part according to the invention.

Turning now in detail to the drawings, FIG. 1 shows a cut through of a cold formed part 1 with a martensitic hardened surface layer. This is preferably formed from strip stock with a complete thickness 5 which lies in the area of 0.3 to 4.0 mm.

The represented part consists of steel layer material with several layers. These layers cover, in particular, a core area B formed from a low carbon alloy and surface layers A of a carbon rich, martensitic hardened steel. The core layer B can consist of for example of Ck10, DC01, C 10, C 35 or C 53. The outer surface layers can consist of for example of Ck67, C 55, C 67 or also 102 Cr6, x5 Cr Ni 1810 or something similar. The surface layers A also can for their part, consist of steel alloys with respectively different analyses. The unusual feature of the represented part 1 exists wherein the layers A, B, A have already been connected to each other before the cold massive forming on the final measure 5 in accordance with the procedure according to the invention. Thus, at the layer borders there are broad transition zones G which are indicated hatchedly and in which a flat carbon gradient has developed by carbon diffusion between the shift materials which lies in the area of several 1/10 mm.

The complete part 1 (FIG. 1) after for example being cold formed to an engine component has been subjected to a martensitic hardening process. The surface layers A have hardened through this process while the core layer B keeps a relatively high toughness. Because of the flat carbon gradient G according to the invention, a flat tension curve exists at the layer borders so that there is no danger of a chipping off of the surface layers from the core layer B as this exists for example in the case at the roll-plated tape in accordance with the level of technology. Practically no hardness delay occurs at martensitic hardening, this means that there is no un-wanted form and measure change so that part 1 can be taken to the final measure 5 already before the hardening process and no after-work is required as this has to be done by the way of case-hardening.

By the choice of the layer materials, an advantageous strength and hardness course is however reached which is comparable or better as with the case hardening. The through-hardening of the surface layers A at the layer material according to the invention can be performed namely with a short time heat treatment, that is considerably shorter than the process for Austenitising as by the way of case-hardening. By this process, the surface layers A get a more fine-grained hardness structure than would be attainable by case hardening. A possible crack growth is not stamped intercrystallinely but transkristallin and a correspondingly clear improvement on the toughness and according an increase of the life time arises.

Alternatively, component 1 can also have a tempered core layer B in accordance with FIG. 1, that has been hardened particularly martensitic or bainitic, and surface layers relatively tempered not at all or less than this, wherein it is formed from a cold formed multilayer composite material. This material is influencable in strength and/or hardness qualities, has a carbon rich core layer B, which is influencable in its strength and/or hardness qualities, relative to the lower carbon surface layers A. In this case, the zone of the carbon gradient's G, as explained previously, is positioned between layers A, B.

Figure 2:
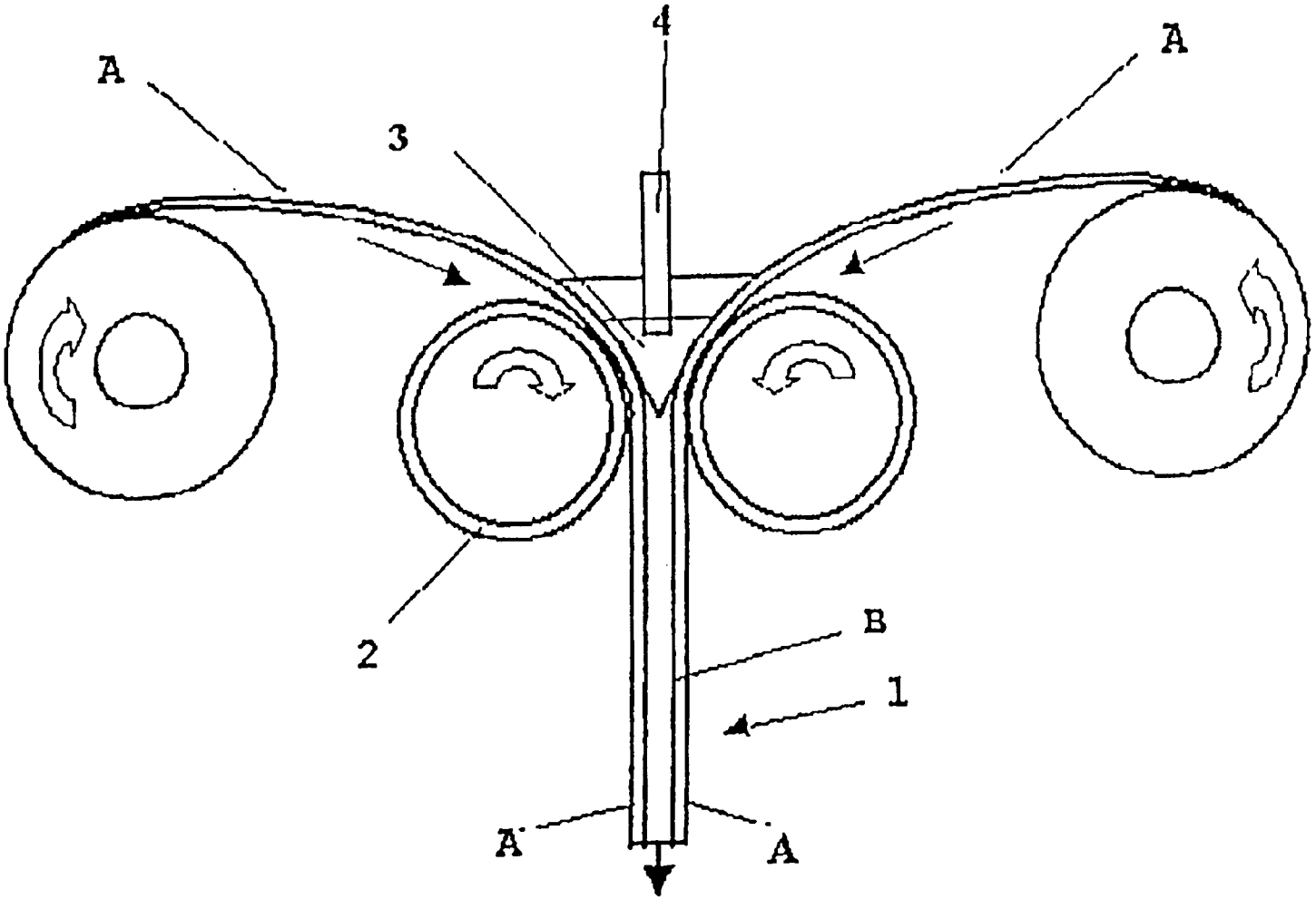
FIG. 2—shows a schematic representation of a casting plant for the production of strip stock according to the invention.

Particularly interesting material matings for the production of spring elements are possible using spring steel influencable in its strength and/or hardness qualities in the core and corrosion resistant for example stainless alloys in the surface layers A. Through this use of materials, an asymmetrical spring way or a self adjusting spring force can be created. This spring can be shown, for example wherein FIG. 2 shows schematically a continuously working casting and rolling plant with two rolls. This shows two rotating, water-cooled copper rolls 2 which limit a casting gap with 1–5 mm of breadth. From above, the glaze marsh 3 is pressurized with glaze liquid material B over a diving tube 4. Along the edges of the casting gap, a strip stock A is brought to by stock coils. With the core material B spilled in the casting gap, the connection takes place between material A supplied as a steel hot strip and material B supplied glaze liquidly. An optimal metallic joint is made in any case by hot rolling by the high surface pressure at temperatures of above 950° C. In the represented plant, the warmth removal along the copper rolls 2 occurs by the steel hot strip A wherein the carbon gradient G of the steel hot strip A does not extend too far. In any case an adequately thick surface layer of the carbon rich, hardenable martensitic edge material A remains available with which parts can be received in the following thermal treatments and hardness procedures with the represented hardness course or the strength distribution.

With the represented plant according to the invention, steel layer materials can be produced with extremely different qualities regarding the strength and/or hardness qualities of the individual layers. The cold deformable composite material can already be well and efficiently processed particularly to final measure. Unlike the known procedures it does not come at hardening following this step to an adverse hardness delay nor is there the danger of the chipping off of surface layers. These show namely a fine, tough hardness structure which does not lead to the rupture of the part even at severe use or short time overload.

Accordingly, while a few embodiments of the present invention have been shown and described, it is to be understood that many changes and modifications may be made thereunto without departing from the spirit and scope of the invention as defined in the appended claims.

What is claimed is:

1. A process for the production of thin walled parts of steel comprising layers, wherein said layers are at least partly differently treatable relating to their strength and hardness qualities, the process comprising the following steps:

a) creating a composite material from a plurality of different layers by connecting at least one core layer and at least one surface layer together wherein at least one layer is cast adjacent to another layer to form a composite material having an alloy gradient that is flat at each interface between any of said at least one core layer and said at least one surface layer;

b) deforming said composite material along a length of said layers;

c) heat treating said layers to transform said strength and hardness qualities of at least one of said layers.

2. The process as in claim 1, wherein said at least one core layer and at least one surface layer have different martensitic hardenability qualities and wherein said process further comprises the step of martensitic hardening at least one core layer and said at least one surface layer to change a strength or hardness quality of said at least one core layer and said at least one surface layer.

3. The process as in claim 1, wherein said layers that are changable in strength and hardness qualities comprise a higher alloyed steel than said layers that are not changed in their strength or hardness qualities.

4. The process as in claim 1, wherein said at least one core layer and said at least one surface layer includes at least one layer that is changed in strength and hardness quality and at least one layer that is a stainless steel layer.

5. The process as in claim 1, wherein said step of heat treating said layers changes a hardness and strength quality of said at least one surface layer.

6. The process as in claim 1, wherein said step of heat treating said layers to transform said strength and hardness qualities of said layers comprises creating at least one layer having a fine grain structure having a relatively higher toughness and a relatively lower microcrack sensitivity.

7. The process as in claim 1, wherein said step of heat treating said layers to transform said strength and hardness qualities of said layers comprises heat treating said at least one core layer to change the strength and hardness qualities of said at least one core layer.

8. The process as in claim 1, further comprising the step of providing parts of said composite material having a wall thickness of less than 4 mm.

9. The process as in claim 1, wherein said step of heat treating said layers to transform said strength and hardness qualities of said layers results in a transformation across a cross section of at least 10% of said composite material.

10. The process as in claim 1, wherein said step of heat treating said layers includes heat treating to create a gradient that is greater than 0.1 mm in depth across said composite material part.

11. The process as in claim 1, wherein said step of heat treating said layers comprises creating an alloy gradient on about 10–25% of said wall thickness.

12. The process as in claim 1, further comprising the step of arranging blanks made of martensitic hardenable steel in a parallel manner, and positioning a core layer between said blanks, wherein said core layer has a glaze liquid, wherein said core layer is comprised of a lower carbon steel than said surface layers.

13. The process as in claim 12, further comprising the step of cooling said blanks from the outside.

14. The process as in claim 12, further comprising the step of bringing blanks formed as steel hoops to an edge of a casting gap of a casting plant working continuously.

15. The process as in claim 14, further comprising the step of providing an open-ended mold for a rope casting plant.

16. The process as in claim 14, further comprising the step of providing rotating rolls in said casting plant wherein said rotating rolls limit said casting gap.

17. The process as in claim 1, further comprising the step of deforming said composite material by hot rolling said composite material.

18. The process as in claim 1, further comprising the step of deforming said composite material by cold rolling said composite material.

19. The process as in claim 1, further comprising the step of soft annealing said parts of composite material.

20. The process as in claim 1, wherein said step of heat treating said layers includes performing a relatively short time heat treatment.

21. The process as in claim 1, wherein said step of heat treating said layers includes heat treating to form a martensitic hardening of said layers which are then changed in strength or hardness.

22. The process as in claim 1, wherein said step of heat treating results in a locally determined change in strength and hardness qualities of said at least one of said layers.

23. The process as in claim 1, wherein said step of heat treating includes changing a set of martensitic properties for different layers of the parts wherein this process for changing these martensitic properties is performed in a continuous manner.

24. A part made from steel wherein said part is made from a plurality of different steel layers cast together, said part comprising:

a cold rolled multilayer composite material comprising:

a) at least one surface layer which has been changed with regard to strength or hardness quality; and b) at least one core layer which has not been changed in strength or hardness quality wherein the composite material formed from said plurality of different steel layers is formed by connecting said at least one core layer and said at least one surface layer together wherein at least one layer is cast adjacent to another layer to form a composite material having an alloy gradient that is flat at each interface between any of said at least one core layer and said at least one surface layer;

wherein the composite material is deformed along a length of said layers; and wherein said layers are heat treated to transform said strength and hardness qualities of at least one of said surface layers.

25. The part as in claim 24, wherein said at least one surface layer has a higher carbon content than said at least one core layer.

26. The part formed by the process of claim 1, comprising:

a cold rolled multilayer composite material comprising:

a) at least one surface layer which has not been changed with regard to strength or hardness quality; and b) at least one core layer which has been changed in strength or hardness quality.

27. The part as in claim 24, wherein said part has a wall thickness that is less than 4 mm.

28. The part as in claim 24, wherein said part has a carbon gradient that extends between 10 to 30% of a wall thickness of the part.

29. The part as in claim 24, wherein said carbon gradient extends at least 0.1 mm.

30. The part as in claim 24, wherein said part has a surface zone having a relatively higher wear resistant fine microcrack sensitively as compared to a core zone.

* * * * *